US006449905B2

(12) United States Patent
Maki

(10) Patent No.: US 6,449,905 B2
(45) Date of Patent: Sep. 17, 2002

(54) AUTOMATIC OPEN AND CLOSE DEVICE FOR DOOR

(75) Inventor: Hideaki Maki, Kariya (JP)

(73) Assignee: Toyota Shatai Kabushiki Kaisha, Kariya (JP)

( * ) Notice: Subject to any disclaimer, the term of this patent is extended or adjusted under 35 U.S.C. 154(b) by 0 days.

(21) Appl. No.: 09/770,197

(22) Filed: Jan. 29, 2001

(30) Foreign Application Priority Data

Feb. 3, 2000 (JP) ..... 2000-026726
Dec. 20, 2000 (JP) ..... 2000-386929

(51) Int. Cl.[7] ..... E05F 11/00
(52) U.S. Cl. ..... 49/360; 49/358
(58) Field of Search ..... 49/116, 118, 324, 49/360, 358

(56) References Cited

U.S. PATENT DOCUMENTS 4,062,146 A * 12/1977 Grossman et al. ..... 47/17
5,179,304 A * 1/1993 Kenjo et al. ..... 310/12
5,712,516 A * 1/1998 Kabout ..... 310/12
5,852,897 A * 12/1998 Sukale ..... 49/358

FOREIGN PATENT DOCUMENTS

JP 8-232542 9/1996
JP 10-243626 9/1998

* cited by examiner

*Primary Examiner*—Jerry Redman
(74) *Attorney, Agent, or Firm*—Oliff & Berridge PLC

(57) ABSTRACT

A device is structured to be integrated with a major components such as a movable unit and a stator contained in a rail member for easy removal from downward of the lintel, thus eliminating adjustment work on site. Since the door may be simply installed on the hanger, it can be easily installed and removed. Also, the stator and the hanger with rollers may be connected by clamping a projection strip formed on a bottom face of the stator from left and right sides thereof with the hanger with rollers installed on the door, or instead by engaging the hanger with rollers with an engagement portion provided on the stator from both side thereof. Consequently, connecting and releasing of the stator and the hanger is simplified and the ease of maintenance is improved.

18 Claims, 12 Drawing Sheets

AUTOMATIC OPEN AND CLOSE DEVICE FOR DOOR

SUMMARY OF THE INVENTION

It is an object of the invention to provide an automatic open and close device for a door that is superior in workability and maintenance and that is compact enough to be installed inside the groove portion of a lintel.

A first aspect of the invention is an automatic open and close device for a door having a stator of a moving-coil linear motor disposed on an upper end of the door movable along a groove portion formed in the lintel and a movable element that is movable relative to the stator and is fixed, i.e., fitted, to a groove portion of the lintel, wherein a rail member formed in three vertical stages is disposed in the groove portion of the lintel, the stator is slidably disposed in a middle stage of the rail member separately from the door, the movable element is accommodated in and fixed to an upper stage of the rail member, and a hanger with rollers attachable to the door is travellably disposed in a lower stage of the rail member, and the hanger and the stator are connected via a joint.

According to the above aspect, the automatic open and close device for the door has its major components integrated inside the rail member. Accordingly, the device may be easily installed and removed upon maintenance from below the lintel, making adjustment work on site unnecessary. Also, since the door need only be installed on the hanger, installation and removal thereof is easy.

A second aspect of the invention is an automatic open and close device for a door having a stator of a moving-coil linear motor disposed on an upper end of the door movable along a groove portion formed in the lintel and a movable element that is movable relative to the stator and is fixed, i.e., fitted, to a groove portion of the lintel, wherein a rail member formed in three vertical stages is disposed in the groove portion of the lintel, the stator is slidably disposed in a middle stage of the rail member separately from the door, the movable element is accommodated in and fixed to an upper stage of the rail member, and a pair of left and right hangers with rollers attachable to the door is travellably disposed in the lower stage of the rail member, wherein the stator further has, on a bottom face thereof in a longitudinal direction, a projection strip projecting toward the lower stage of the rail member, and each hanger and the stator being connected and made into one piece by installing each hanger to the door such that the projection strip is clamped between each hanger from both sides in the longitudinal direction.

In the automatic open and close device for the door in the second aspect, the connection between the stator disposed slidably in the middle stage of the rail member and the pair of left and right hangers with rollers travellably disposed in the lower stage of the rail member is achieved by clamping the projection strip provided on the lower face of the stator in the longitudinal direction thereof from both sides in the longitudinal direction by the pair of left and right hangers with rollers installed on the door. Accordingly, in addition to the effect obtained by the first aspect, the hanger with rollers can be replaced without removing the stator from the rail member, simplifying the replacement work and improving ease of maintenance.

A third aspect of the invention is an automatic open and close device for a door having a stator of a moving-coil linear motor disposed on an upper end of the door movable along a groove portion formed in the lintel and a movable element that is movable relative to the stator and is fixed, i.e., fitted, to a groove portion of the lintel, wherein a rail member formed in two vertical stages is disposed in the groove portion of the lintel, the stator is slidably disposed in an upper stage of the rail member separately from the door, the movable element is accommodated in and fixed to a portion thereabove, and a pair of left and right hangers with rollers that is attachable to the door is travellably disposed in the lower stage of the rail member, wherein the movable element is further provided with a space-keeping roller for maintaining a constant between the movable element and the stator which is attracted toward the movable element side due to the magnetic attraction acting between the movable element and the stator, and the stator further has, in a longitudinal direction of a lower face thereof, a projection strip projecting toward the lower stage of the rail member, and the hanger and the stator being connected and made into one piece by installing each hanger to the door such that the projection strip is clamped between each hanger from both sides of the longitudinal direction.

In the automatic open and close device for door in the second aspect, the connection between the stator disposed slidably in the middle stage of the rail member and the pair of left and right hangers with rollers travellably disposed in the lower stage of the rail member is achieved by clamping the projection strip provided on the lower face of the stator in the longitudinal direction thereof from both sides in the longitudinal direction by the pair of left and right hangers with rollers installed on the door. Accordingly, in addition to the effect obtained by the first aspect, the hanger with rollers can be replaced without removing the stator from the rail member, simplifying the replacement work and improving ease of maintenance.

A third aspect of the invention is an automatic open and close device for door having a stator of a moving-coil type linear motor disposed on an upper end of a door movable along a groove portion formed in the lintel and a movable element that is movable relative to the stator and is fixed to a groove portion of the lintel, wherein a rail member formed in two vertical stages is disposed in the groove portion of the lintel, the stator is slidably disposed in an upper stage of the rail member separately from the door, the movable element is accommodated in and fixed to a portion thereabove, and a pair of left and right hangers with rollers that is attachable to the door is travellably disposed in the lower stage of the rail member, wherein the movable element is further provided with a space-keeping roller for maintaining a constant between the movable element and the stator which is attracted toward the movable element side due to the magnetic attraction acting between the movable element and the stator, and the stator further has, in a longitudinal direction of a lower face thereof, a projection strip projecting toward the lower stage of the rail member, and the hanger and the stator being connected and made into one piece by installing the hanger to the door such that the projection strip is clamped between the hanger from both sides in the longitudinal direction.

In the third aspect, the stator is pulled toward the movable element by the magnetic attraction that acts between the movable element and the stator. Further, the space-keeping roller provided on the movable element keeps the distance between the movable element and the stator accommodated in the upper stage of the rail member constant. Thus, in addition to the effect obtained by the first aspect, a frictional resistance between the rail member and the stator upon opening and closing of the door can be reduced. Also, since the stator and the hanger with rollers are connected by clamping the projection strip provided on the lower face of the stator in the longitudinal direction thereof from both sides in the longitudinal direction with a pair of left and right hangers with rollers installed on the door, the hanger with rollers can be replaced without removing the stator from the rail member, simplifying the replacement work and improving ease of maintenance.

A fourth aspect of the invention is an automatic open and close device for a door having a stator of a moving-coil linear motor disposed on an upper end of a door movable along a groove portion formed in the lintel and the movable element that is movable relative to the stator and is fixed, i.e., fitted, to a groove portion of the lintel, wherein a rail member formed in two vertical stages is disposed in the groove portion of the lintel, the stator is slidably disposed in an upper stage of the rail member separately from the door, the movable element is accommodated in and fixed to a portion thereabove, and a pair of left and right hangers with rollers that is attachable to the door is travellably disposed in the lower stage of the rail member, and the stator has on both ends of the lower face thereof in the longitudinal direction an engagement portion engageable with each hanger, and each hanger and the stator are integrally connected by engaging with the engagement portion from both sides of the stator.

In the fourth aspect, the stator and the hanger with rollers are connected by engaging the hanger with rollers with the engagement portion provided on the lower face of the stator in the longitudinal direction thereof from both ends of the stator. Accordingly, in additions to the effect obtained by the first aspect, connecting and releasing of the stator and the hanger with rollers can be easily conducted inside the rail member, and the replacement work of the hanger with rollers becomes simple. Further, since the configuration is such that the stator is supported by the hanger with rollers in a state where the stator and the hanger with rollers are connected, the stator can be kept out of contact with the rail member and the movable element, thus making the operation of the linear motor smooth.

DETAILED DESCRIPTION OF PREFERRED EMBODIMENTS (First Embodiment)

Hereinafter, a first embodiment of the invention will be described with reference to the attached drawings.

Figure 1:
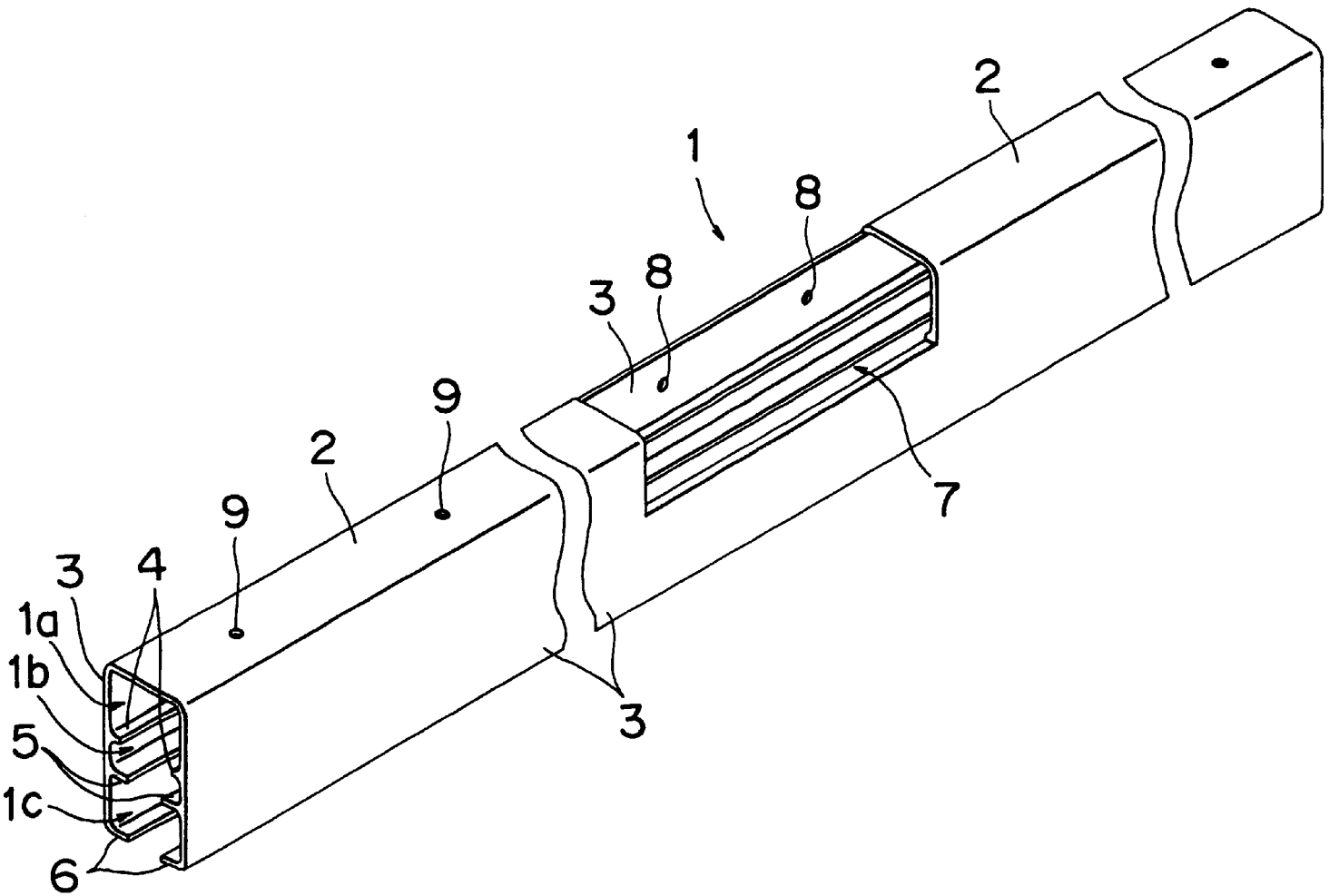
FIG. 1 is a perspective view of a rail member according to a first embodiment of the invention.
Figure 2:
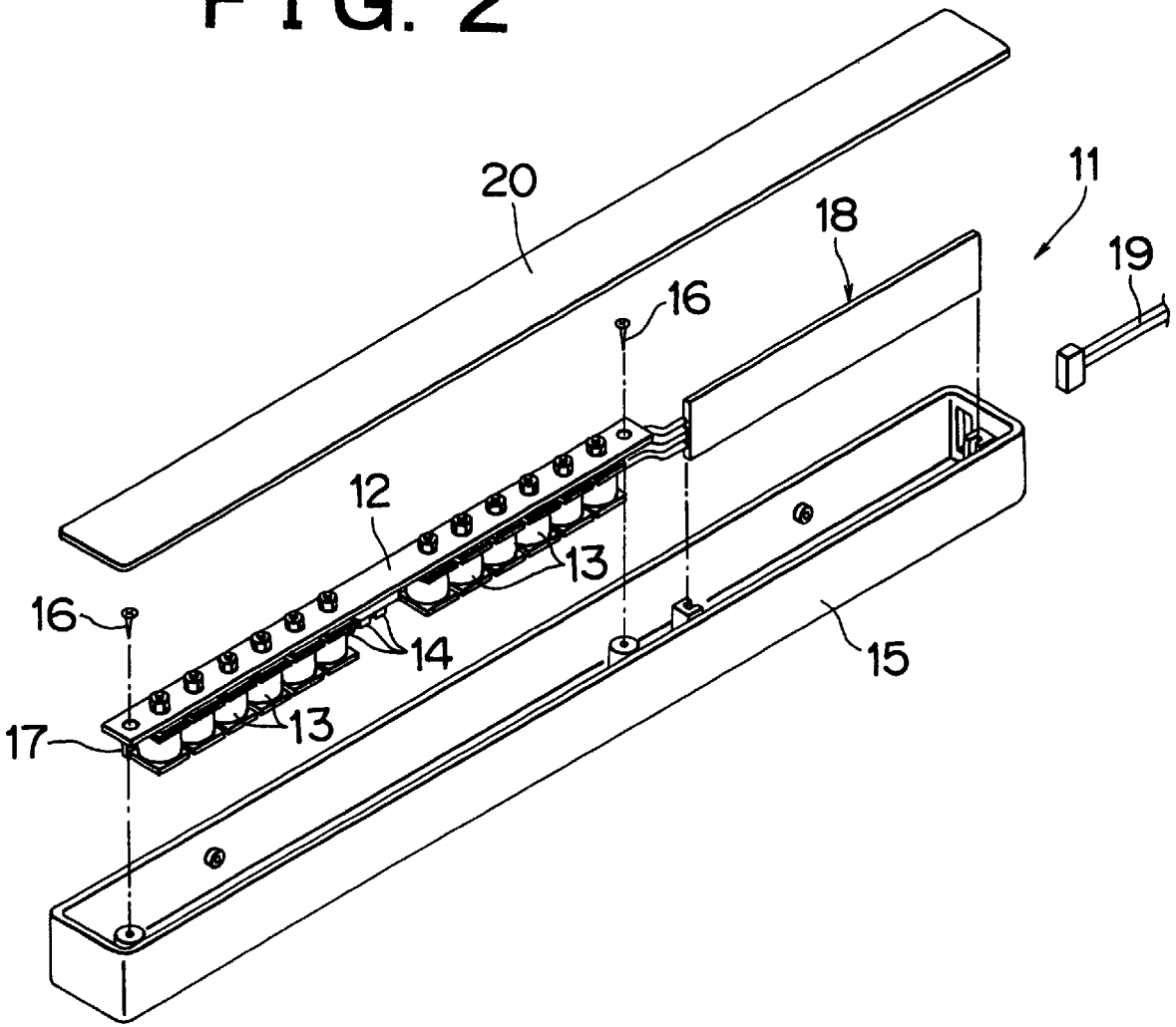
FIG. 2 is an exploded perspective view of a movable unit according to the first embodiment of the invention.
Figure 3:
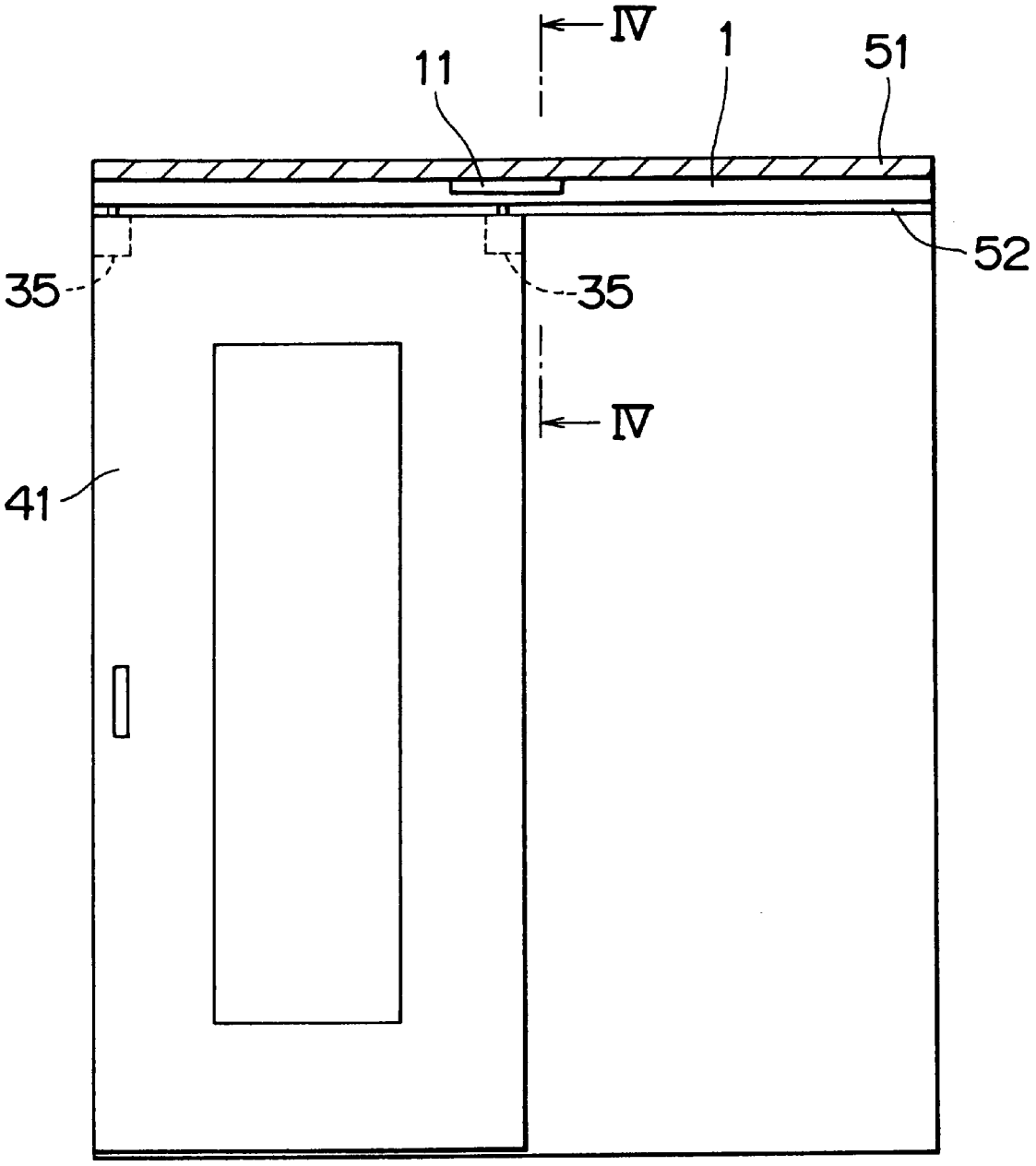
FIG. 3 is a front view illustrating an assembled state of an automatic open and close device for a door according to the first embodiment of the invention.
Figure 4:
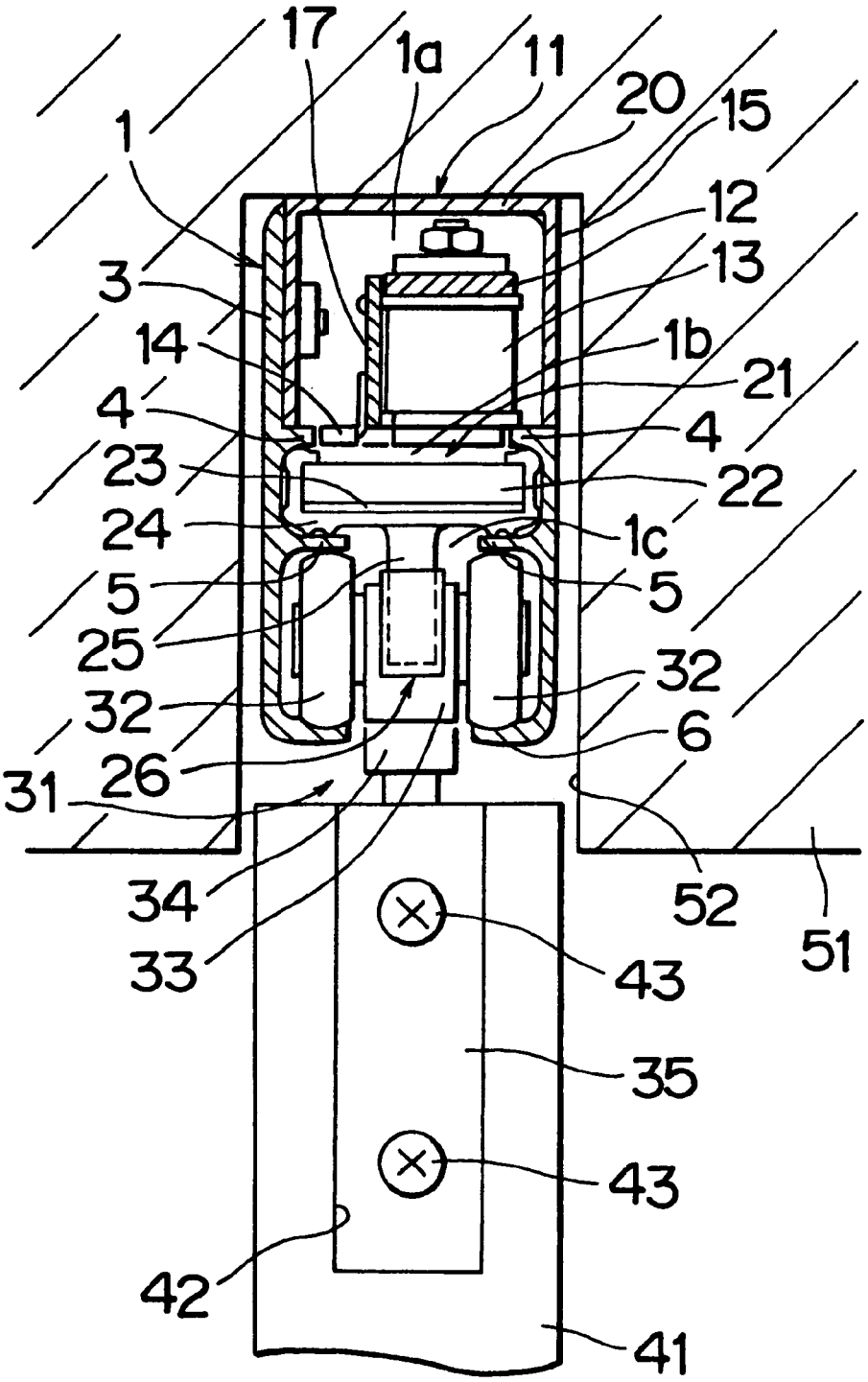
FIG. 4 is a sectional view of the automatic open and close device taken along line IV—IV in FIG. 3.
Figure 5:
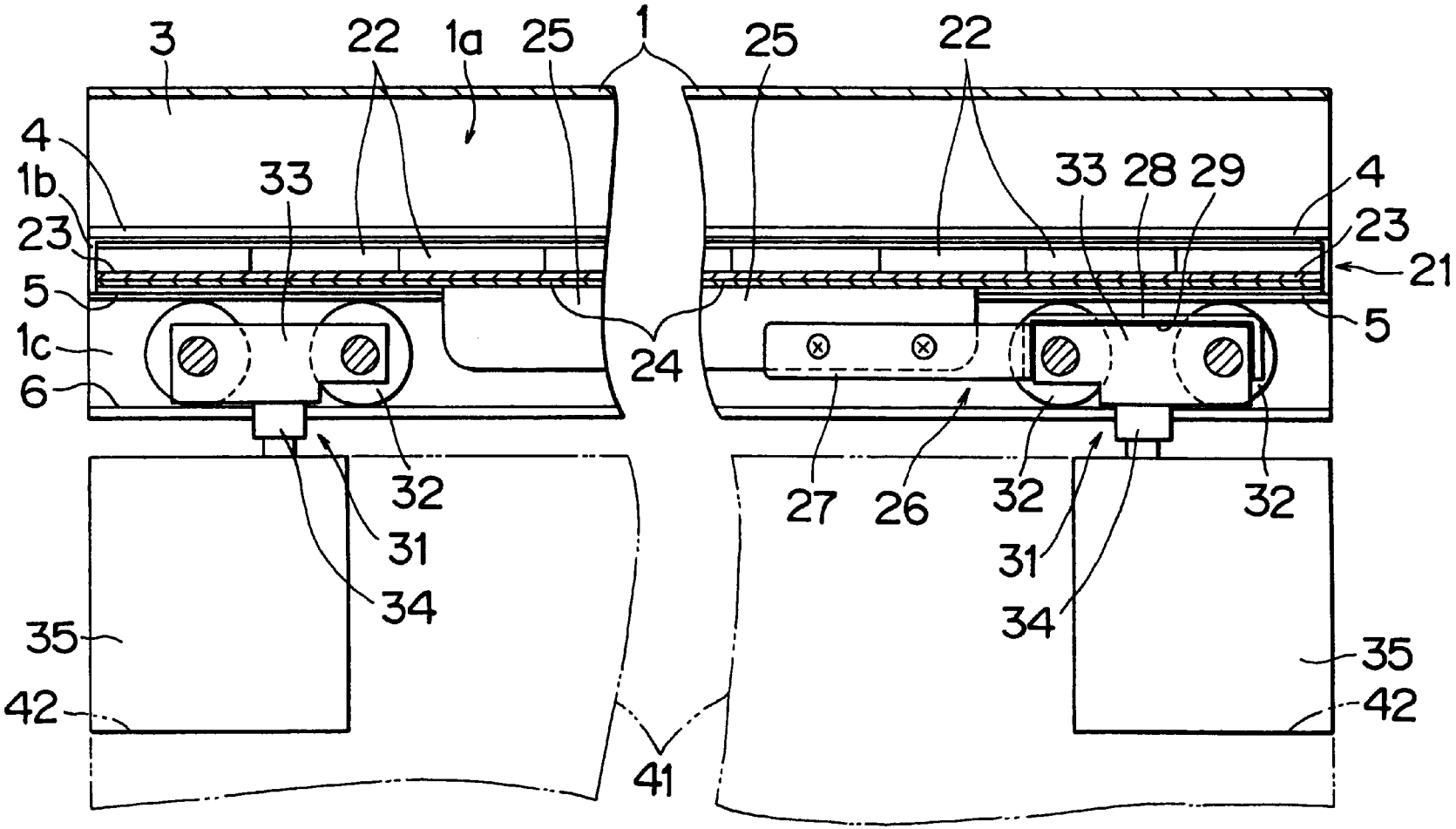
FIG. 5 is a sectional view showing major portions of the automatic open and close device for a door according to the first embodiment of the invention.

FIG. 1 is a perspective view of a rail member 1, FIG. 2 is an exploded perspective view of a movable unit, FIG. 3 is a front view of an assembled state, FIG. 4 is sectional view taken along line IV—IV in FIG. 3, and FIG. 5 is a sectional view of major portions. The rail member 1 having a generally inverted U-shaped cross section is a composite aluminum part made by extrusion molding, wherein opposing walls 3, 3 on both sides of a ceiling 2, support projections 4, 4, and shelves 5, 5 for sliding are integrally formed. Hanger rails 6, 6 that bend toward the inside are formed at lower ends of the opposing walls 3, 3.

An inner space of the rail member 1 is divided into three vertical stages, an upper stage 1*a*, a middle stage 1*b*, and a lower stage 1*c* by means of the support projections 4, 4 and the shelves 5, 5. Further, at a generally central portion of the upper stage 1*a* in a longitudinal direction, a fitting portion 7 is formed by cutting off a portion of the ceiling 2 and one of the opposing walls 3 so as to attach the movable unit 11 described later. On the opposing wall 3 where the fitting portion is located, a thread hole 8 for fixing a movable unit 11 is provided. In the ceiling 2, a thread hole 9 for fixing the rail member 1 in a groove portion 52 of a lintel 51 is provided. The rail member 1 is cut into a size corresponding to the length of the lintel 51, on which the door 41 slides dividedly, such that the fitting portion 7 is located at the center of the rail member 1 in the longitudinal direction.

As shown in FIG. 2, the movable unit 11 of a moving-coil type linear motor includes a plurality of coils 13 with iron cores disposed in tandem on an installation plate 12 that also acts as a yoke, and a magnetic sensor 14 disposed at a center thereof. The installation plate 12 is fixed inside a case 15 with tightening screws 16. Lower ends of the coil 13 and the magnetic sensor 14 are located inside an opening (not shown) provided on a bottom face or the case 15. Further, a circuit board 17 and a controller 18 for supplying the respective coils 13 with electricity are mounted inside the case 15. A power supply cord 19 is connected to the controller 18 and the opening thereabove is covered by an upper lid 20. The case 15 is fitted to the fitting portion 7 of the rail member 1 and is supported by the support projections 4, 4 to be fixed to the opposing wall of the rail member 1 with tightening screws not shown.

At the middle stage 1*b* of the rail member 1, a stator 21 of the moving-coil linear motor is slidably inserted on the shelves 5, 5 separately from the door 41. The stator 21 is formed generally in a same size as a width of the door 41, and includes permanent magnets 22 magnetized in a width direction thereof disposed on a yoke 23 made of iron such that polarity of adjacent magnets differ from each other. The stator 21 also includes a resin case 24 having a low frictional resistance. The case 24 is opened at an upper face thereof facing the coil 13 and the magnetic sensor 14 of the moving-coil type unit 11, and the case 24 includes an integrally formed projection strip 25 for reinforcement on a bottom face thereof in a longitudinal direction. Both ends of the projection strip 25 are cut off so that its length is shorter than the total length of the case 24. On one end of the projection strip 25, a joint 26 is attached. The joint 26 is formed by bending a fitting portion 28 that is fitted into an installation portion 27 and a traveling body 33 of a hanger 31 described later. A cushion rubber 29 covers the fitting portion 28.

The hanger 31 includes four rollers 32, travelably supported by hanger rails 6, 6 of the rail member 1, each provided in the front and back and left and right of the hanger 31. The hanger also includes the travelling body 33 that travels within the lower stage 1*c* of the rail member 1 and a hanger main body 35 hung from a hanging shaft 34 projecting downward from the bottom face of the travelling body 33 passing through the hanger rails 6, 6. The hanger 31 is connected to the stator 21 by fitting the fitting portion 28 of the joint 26 with the travelling body 33.

The rail member 1 with built-in movable unit 11, stator 21, and hanger 31 is disposed inside the groove portion 52 of the lintel 51 such that the movable unit 11 is located in the longitudinal direction thereof. The hanger main body 35 is fitted with a fit installation portion 42 formed at an upper end of the fitting portion of the door 41 and is tightened with fixing screws 43 so as to hang the door 41 inside the groove portion 52 of the lintel 51.

In the above-mentioned open and close device for a door, operation of an open/close switch (not shown), or moving of the door 41 slightly in an opening direction (assist function) causes a controller 18 to switch the energizing direction of the respective coils 13 of the movable unit 11 based on a relative position of the coils 13 and the permanent magnet 22 detected by the magnetic sensor in a timely manner. This generates polarity in the iron cores of the respective coils 13 that is attracted to or repelled from the polarity of the permanent magnet 22, which then generates a thrust in a predetermined direction between the movable unit 11 and the stator 21. Accordingly, the stator 21 slides within the middle stage 1*b* such that the door is pulled to be opened or closed.

As described above, since the automatic open and close device for the door according to the first embodiment has major components such as the movable unit 11, the controller 18, the stator 21, and the hanger 31 integrated within the rail member 1, installation and removal upon maintenance can be easily conducted from below the lintel 51, eliminating adjustments made on site. Since the door 41 is simply installed on the hanger main body 35, installation and removal thereof is easy. Also, a composite structure of the rail member 1 by extrusion molding cuts down on manufacture cost and improves ease of maintenance.

The stator 21 is covered by a resin case 24 having low frictional resistance on side faces and a bottom face thereof that contact the middle stage 1*b* of the rail member 1, avoiding the permanent magnet 22 and the top face of the yoke 23. Accordingly, the sliding resistance of the stator 21 sliding within the middle stage 1*b* is reduced allowing the door 41 to be smoothly opened and closed. Further, since the controller 18 is built into the movable unit 11 fitted to the fitting portion 7 of the rail member 1, installation and removal on site become even simpler.

Figure 6:
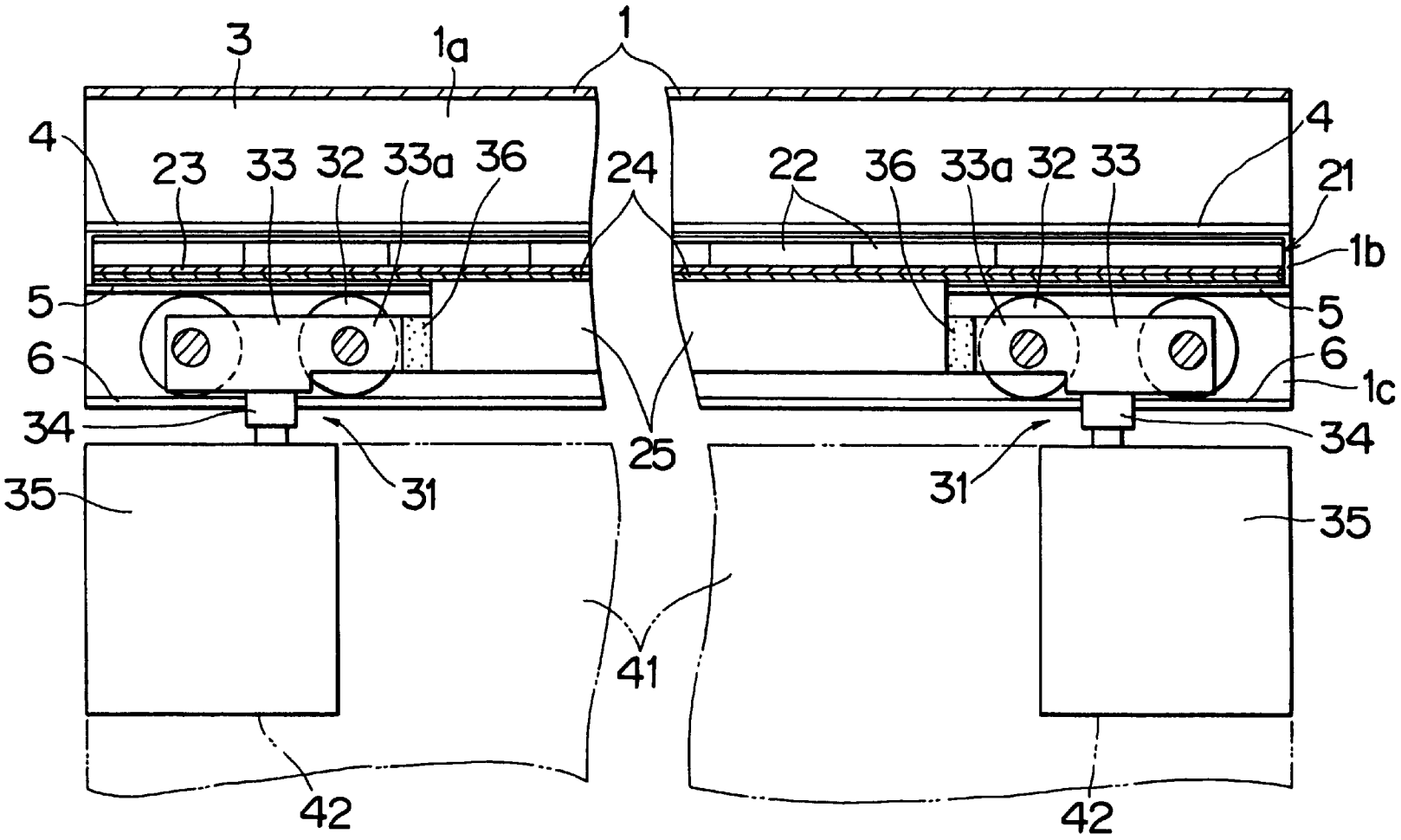
FIG. 6 is a sectional view of major portions of a modified example of first embodiment of the invention corresponding to FIG. 5.

FIG. 6 shows a modified example of the first embodiment. As shown in FIG. 6, clamping portions 33*a* are formed on the travelling bodies 33 of a pair of left and right hangers 31. When the left and right hangers 31 are fit to be installed on the fit installation portion 42 of the door, the clamping portions 33*a* of the respective hangers contact the projection strip 25 integrally formed on the bottom face of the case 24 of the stator 21 so as to clamp the projection strip from left and right sides. Therefore, the length of the projection strip 25 is set to be in accordance with the space between the left and right hangers 31. Further, on the left and right sides of the projection strip 25, a cushion rubber for preventing looseness is attached.

In the above-mentioned open and close device for a door, the door 41 is fitted inside the groove portion 52 of the lintel 51, and the hanger main body 35 of the left and right hangers 31 the rollers 32 of which are travelably supported by the hanger rails 6, 6 of the rail member 1 is fittingly installed on the respective fit installation portion 42 of the door 41. Accordingly, the door 41 is hung inside the groove portion 52 of the lintel 51, and the projection strip 25 of the stator 21 is clamped from left and right sides thereof by the clamping portions 33*a* of the travelling body 33 so as to bring the stator 21 and the hanger 31 into communication.

Consequently, replacement of the hanger 31 can be done without having to remove the stator 21 from the rail member 1, only requiring removal of the hanger 31 from the fit installation portion 42 of the door 41, thus improving ease of maintenance.

(Second Embodiment)

Figure 7:
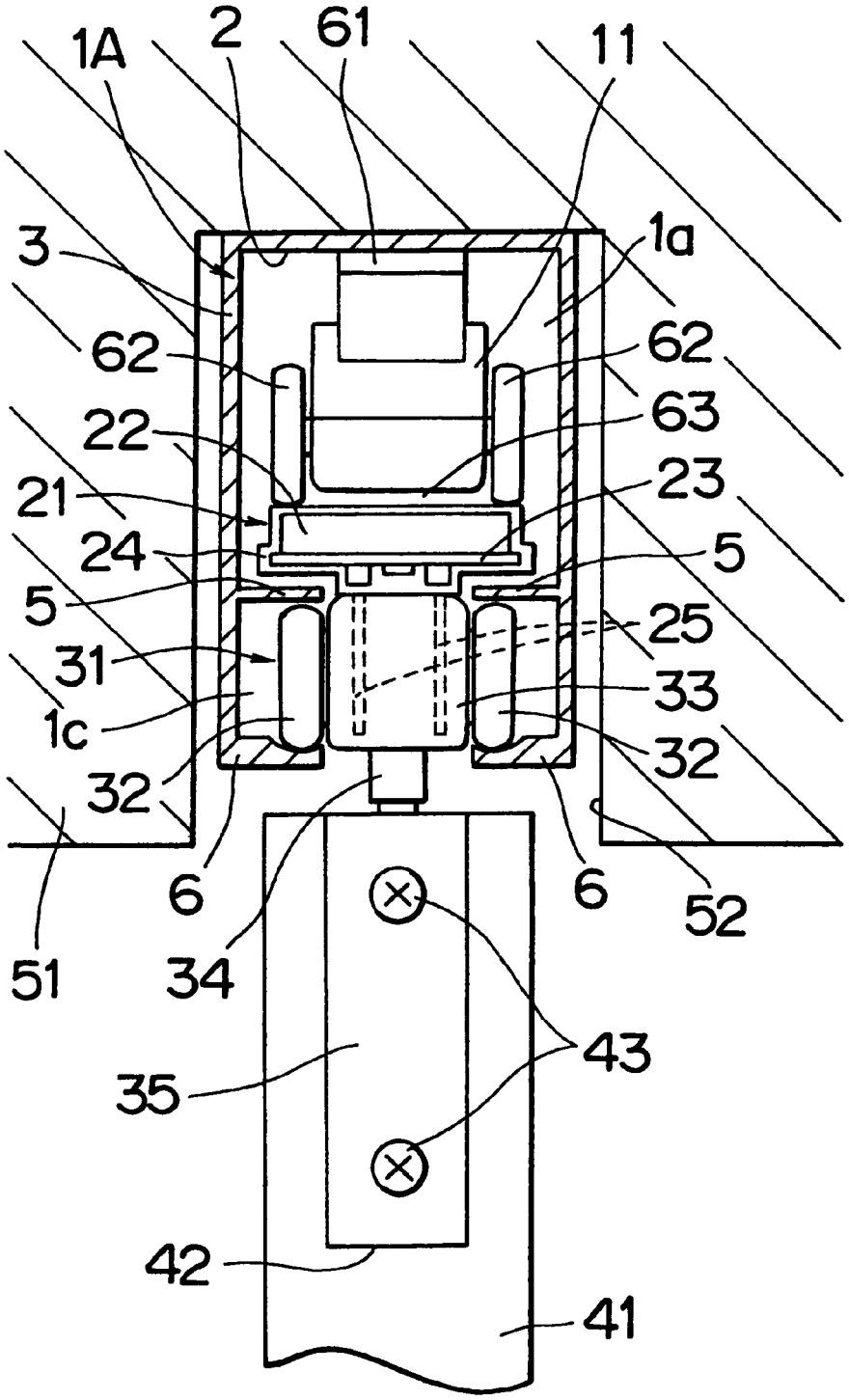
FIG. 7 is a sectional view of major portions of the automatic open and close device for a door according to a second embodiment of the invention corresponding to FIG. 4.
Figure 8:
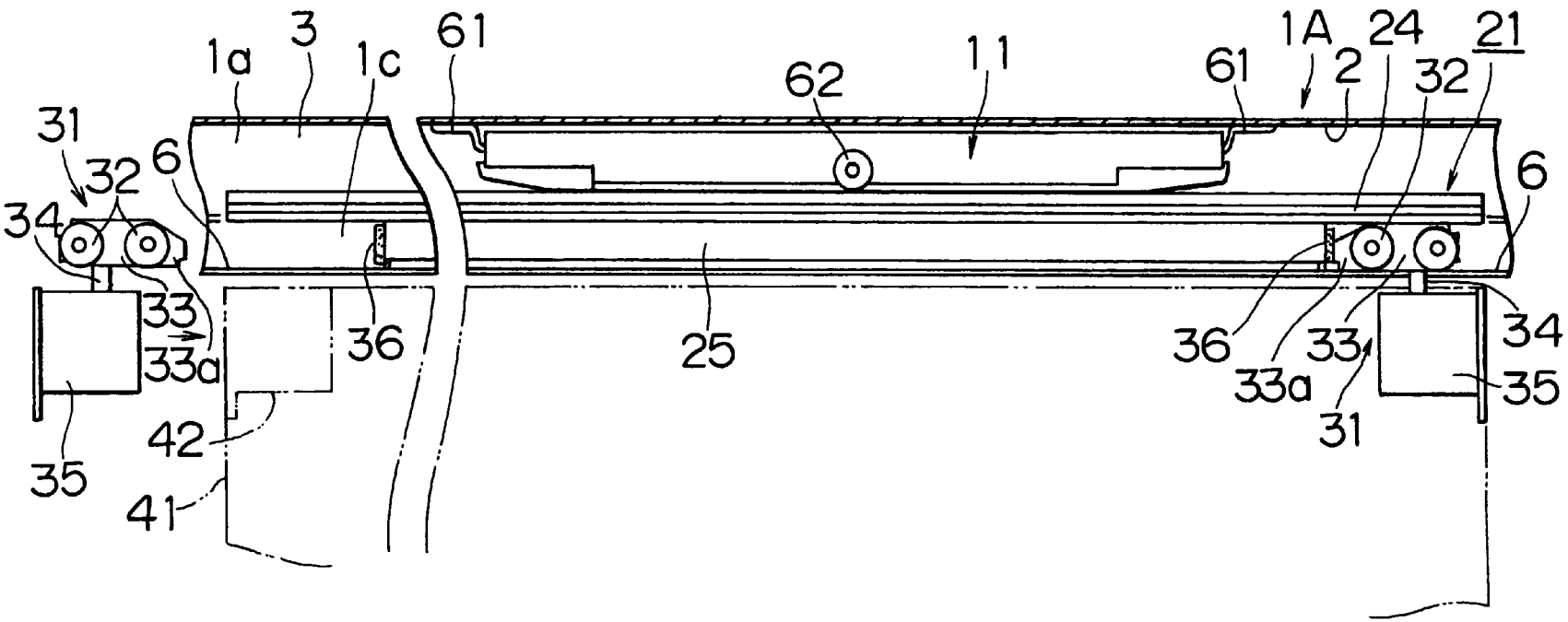
FIG. 8 is a sectional view of major portions of the automatic open and close device for a door according to a second embodiment of the invention corresponding to FIG. 5.

FIG. 7 and FIG. 8 illustrate an open and close device for a door according to a second embodiment. The basic construction of the second embodiment is in accordance with the basic construction of the first embodiment. Therefore, a same reference numeral will be given to a same construction to omit detailed description therefor. A rail member 1A having a generally inverse U-shaped cross section is a composite part made by aluminum extrusion molding, wherein the shelves 5, 5 are integrally formed on the opposing walls 3, 3 on both sides of the ceiling 2 and extend toward the inside. The hanger rails 6, 6 that bend toward the inside are formed at lower ends of the opposing walls 3, 3. The space inside the rail member 1A is divided into two vertical stages, the upper stage 1*a* and the lower stage 1*c*, by the shelves 5, 5. At a generally central portion of the rail member 1A in a longitudinal direction thereof, the movable unit 11 described in the first embodiment is mounted on the ceiling 2 of the upper stage 1*a* by a bracket 61.

Figure 9:
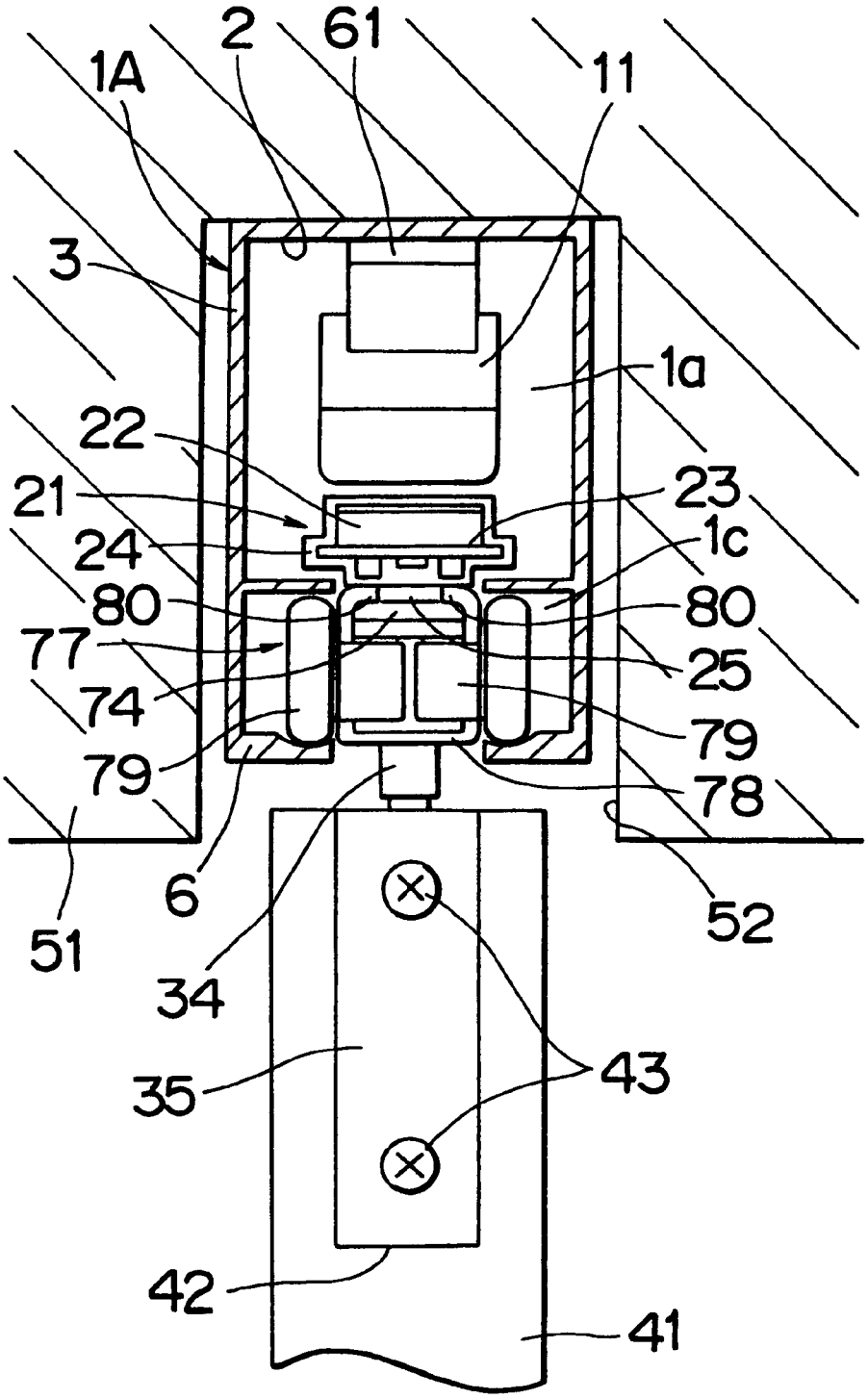
FIG. 9 is a sectional view of major portions of an automatic open and close device for a door according to a third embodiment of the invention corresponding to FIG. 4.

As shown in FIG. 9, space-keeping rollers 62 are mounted on both sides of the movable unit 11 at the center in the longitudinal direction thereof. The space-keeping rollers 62 roll in contact with the top face of the aluminum case 24 of the stator 21 disposed inside the upper stage 1*a* of the rail member 1A facing the movable unit 11. The rollers 62 keep a constant distance between the movable unit 11 and the stator 21 which is attracted toward the movable unit 11 side due to the magnetic attraction acting between the movable unit 11 and the stator 21

On the bottom face of the case 24 of the stator 21, a projection strip 25 projecting toward the lower stage 1*c* of the rail member 1A is integrally formed in the longitudinal direction of the rail member 1A. Both ends of the projection strip 25 are cut off such that when the left and right hangers 31 are installed on the fit installation portion 42 of the door 41, the clamping portions 33*a* of the hanger 31 contact both ends of the projection strip 25 and the clamping portions 33*a* clamp the projection strip 25 from left and right sides. Accordingly, the projection strip 25 has a length equal to the distance between the left and right hangers 31. Further, a cushion rubber for preventing looseness is attached to left and right sides of the projection strip 25.

In the automatic open and close device for a door described above, just as in the modified example of the first embodiment, the door 41 is fitted into the groove portion 52 of the lintel 51, and the hanger main bodies 35 of the left and right hangers 31 the rollers 32 of which are travelably supported by the hanger rails 6, 6 of the rail member 1A are respectively fitted with the fit installation portion 42 of the door 41 to be tightened by the fixing screws. A constant distance is kept between the movable unit 11 and the stator 21 by the space-keeping roller 62, reducing friction upon opening and closing of the door 41. Moreover, the replacement of the hanger 31 can be done simply by removing the hanger main body 35 from the fit installation portion 42 of the door 41. Since it is not necessary to remove the stator 21 from the rail member 1A, the replacement work is simplified and the ease of maintenance is improved.

(Third Embodiment)

Figure 10:
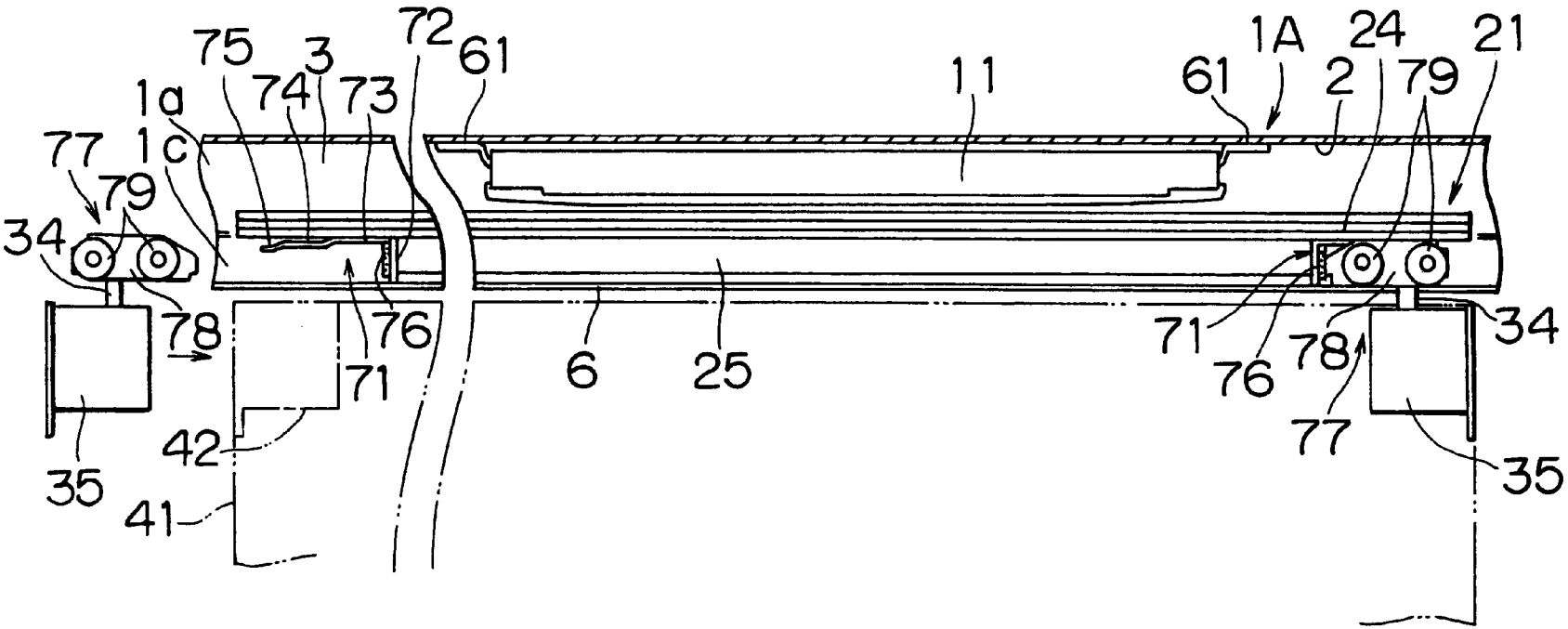
FIG. 10 is a sectional view of major portions of an automatic open and close device for a door according to the third embodiment of the invention corresponding to FIG. 5.
Figure 11:
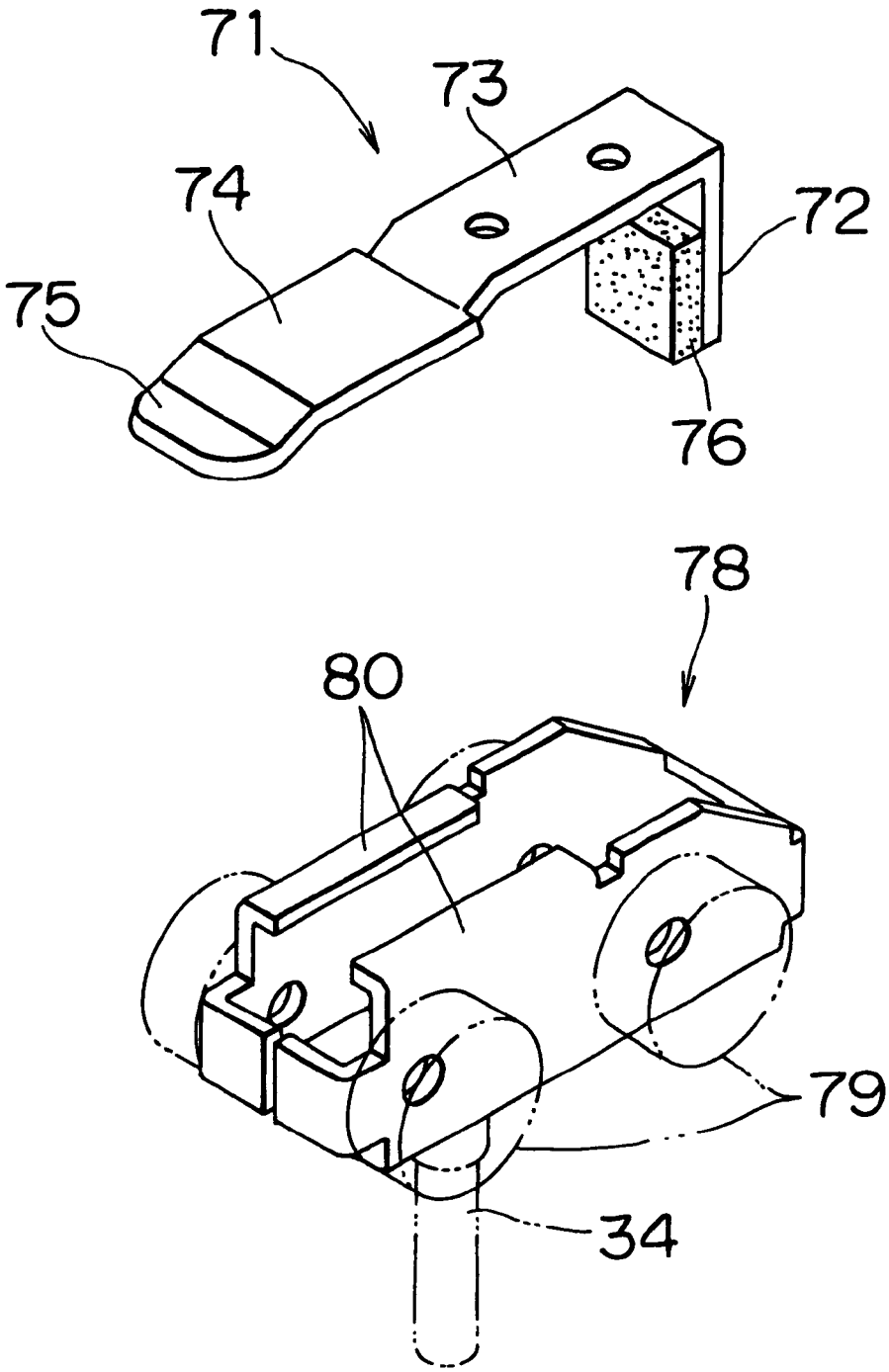
FIG. 11 is a perspective view of an engagement member and a hanger according to the third embodiment of the invention.
Figure 12:
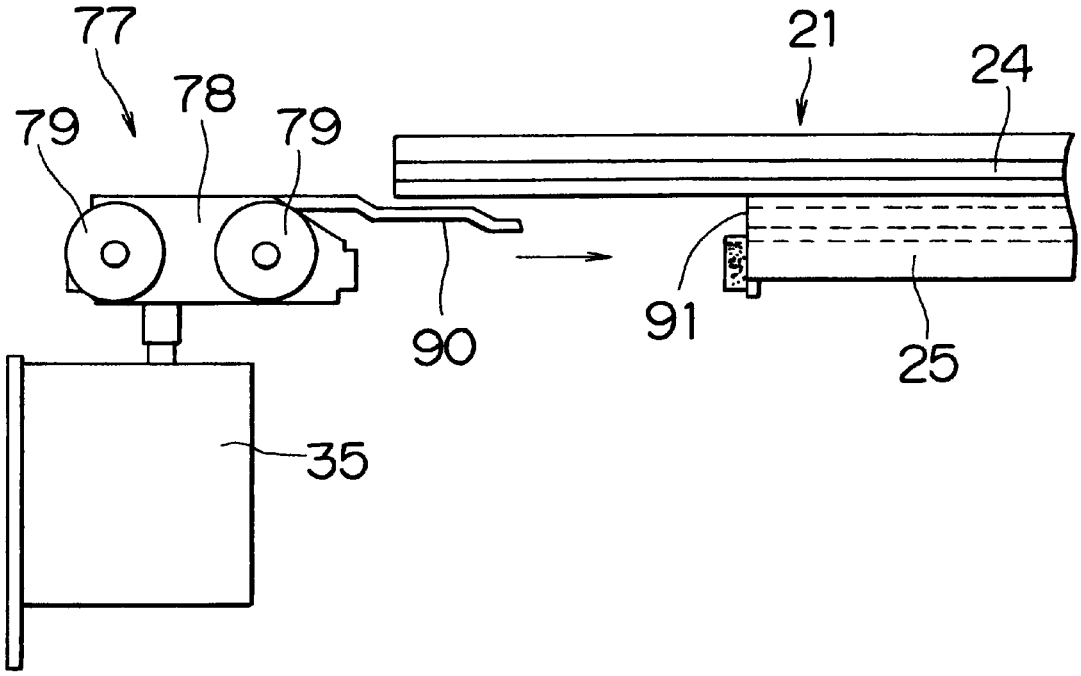
FIG. 12 is an explanatory diagram illustrating another way of connecting the stator and the hanger according to the third embodiment of the invention.

FIGS. 9 through 11 illustrate an automatic open and close device for a door according to a third embodiment.

The basic construction of the third embodiment is in accordance with the basic constructions of the first and the second embodiments. Accordingly, a same construction will be given a same reference numeral as used for the first and the second embodiments so as to omit detailed description thereof. On a bottom face of the aluminum case 24 of the stator 21 disposed inside the upper stage 1*a* of the rail member 1A facing the movable unit 11, the projection strip 25 projecting toward the lower stage 1*c* of the rail member 1A is integrally formed in the longitudinal direction thereof. Further, engagement members 71 are clamped to the notch portions on both ends of the projection strip 25.

As shown in FIG. 11, the width of the engagement member 71 is such that it can be inserted into a travelling body 78 of a hanger 77 described later. An abutting portion 72 that abuts against the end face of the projection strip 25 is bendingly formed on the engagement member 71 at a right angle. Further, a clamping portion 73, an engagement portion 74, and an engagement guide portion 75 are sequentially bendingly formed from the abutting portion 72. A cushion rubber 76 is attached to the abutting portion 72. The travelling body 78 of the hanger 77 is formed by being bent into a generally U-shaped cross section and mounting rollers 79 on both sides thereof, while projecting the hanging shaft 34 from the bottom face thereof to hang the hanger main body 35. At the upper end of the travelling body 78 having a generally U-shaped cross section, flanging portions 80 bent inward and that face each other are formed.

The stator 21 and the hanger 77 are connected by moving the travelling body 78 supported by the hanger rail of the rail member 1A in a travelling direction thereof and inserting the flange portion 80 of the travelling body 78 between the engagement portion 74 of the engagement member 71 and the bottom face of the case 24 to be engaged therewith. At this time, the travelling body 78 of the hanger 77 is located by being abutted against the cushion rubber 76 attached to the abutting portion 72. Further, by connecting the stator 21 and the hanger 77 as described above, the stator 21 is retained by the hanger 77 so that the movement in the vertical direction is restricted. Accordingly, the distance between the stator 21 and the movable unit 11 is kept constant.

In the automatic open and close device for the door described above, the stator 21 and the hanger 77 are connected by inserting the flange portion 80 formed on the running body 78 of the hanger 77, from both ends of the stator 21, between the engagement members 71 clamped at both ends of the bottom face of the stator 21 in the longitudinal direction thereof and the bottom face of the rail member 1A to be engaged therewith. Accordingly, connecting the hanger 77 to the stator 21 and removing the hanger 77 therefrom can be easily conducted by simply moving the hanger 77 in the travelling direction.

Further, an engagement piece 90 may be provided on the hanger 77 side and an engagement hole 81 on the stator 21 side for engagement with the engagement piece 90 may also be provided.

What is claimed is:

1. An automatic open and close device for a door, comprising:

a stator of a moving-coil linear motor disposed on an upper end of the door movable along a groove portion in a lintel;

a movable element fitted to the groove portion of the lintel and relatively movable with respect to the stator;

a rail member formed in three vertical stages that are disposed in the groove portion of the lintel, wherein the stator is slidably disposed at a middle stage of the rail member separately from the door, and the movable element is accommodated in an upper stage of the rail member;

a hanger with rollers travelably disposed at a lower stage of the rail member and attachable to the door; and a joint that connects the hanger with the stator.

2. An automatic open and close device according to claim 1, wherein the rail member is made by extrusion molding.

3. An automatic open and close device according to claim 1, wherein a controller that controls the linear motor is contained within the movable element.

4. An automatic open and close device according to claim 1, wherein the stator is covered by a case that is made of resin.

5. An automatic open and close device for a door, comprising:

a stator of a moving-coil linear motor disposed on an upper end of the door movable along a groove portion in a lintel;

a movable element fitted to the groove portion of the lintel and relatively movable with respect to the stator;

a rail member formed in three vertical stages that are disposed in the groove portion of the lintel, wherein the stator is slidably disposed at a middle stage of the rail member separately from the door, and the movable element is accommodated in an upper stage of the rail member;

a pair of left and right hangers with rollers travelably disposed at a lower stage of the rail member and attachable to the door; and a projection strip provided on a bottom face of the stator that projects toward the lower stage of the rail member in a longitudinal direction thereof, wherein the projection strip is clamped from both sides in the longitudinal direction thereof by installing each hanger to the door so as to integrally connect each hanger and the stator.

6. An automatic open and close device according to claim 5, wherein the rail member is made by extrusion molding.

7. An automatic open and close device according to claim 5, wherein a controller that controls the linear motor is contained within the movable element.

8. An automatic open and close device according to claim 5, wherein the stator is covered by a case that is made of resin.

9. An automatic open and close device for a door, comprising:

a stator of a moving-coil linear motor disposed on an upper end of the door movable along a groove portion in a lintel;

a movable element fitted to the groove portion of the lintel and relatively movable with respect to the stator;

a rail member formed in two vertical stages that are disposed in the groove portion of the lintel, wherein the stator is slidably disposed at an upper stage of the rail member separately from the door, and the movable element is accommodated in and fixed to a portion thereabove;

a pair of left and right hangers with rollers travelably disposed at a lower stage of the rail member and attachable to the door;

a space-keeping roller provided on the stator to maintain a constant distance between the movable element and the stator that is attracted to a side of the movable element due to a magnetic attraction acting between the movable element and the stator; and a projection strip provided on a bottom face of the stator and that projects toward the lower stage of the rail member in a longitudinal direction thereof, wherein the projection strip is clamped from both sides in the longitudinal direction thereof by mounting each hanger to the door so as to integrally connect each hanger and the stator.

10. An automatic open and close device according to claim 9, wherein the rail member is made by extrusion molding.

11. An automatic open and close device according to claim 9, wherein a controller that controls the linear motor is contained within the movable element.

12. An automatic open and close device according to claim 9, wherein the stator is covered by a case that is made of in aluminum.

13. An automatic open and close device for a door, comprising:

a stator of a moving-coil linear motor disposed on an upper end of the door movable along a groove portion in a lintel;

a movable element fitted to the groove portion of the lintel and relatively movable with respect to the stator;

a rail member formed in two vertical stages that are disposed in the groove portion of the lintel, wherein the stator is slidably disposed at an upper stage of the rail member separately from the door, and the movable element is accommodated in a portion thereabove;

a pair of left and right hangers with rollers travelably disposed at a lower stage of the rail member and attachable to the door; and an engagement portion provided on a bottom face of the stator at both ends thereof in the longitudinal direction that is engageable with each hanger, wherein each hanger and the stator are integrally connected by engaging each hanger with the engagement portion from both ends of the stator.

14. An automatic open and close device according to claim 13, wherein the engagement portion includes a clamping portion that is fixed to the stator and an elongated portion that elongates from the clamping portion in a direction toward each hanger, and wherein each hanger includes a flange portion that engages with the elongated portion.

15. An automatic open and close device according to claim 13, wherein the engagement portion includes an engagement hole, and wherein each hanger includes an engagement piece that engages with the engagement hole.

16. An automatic open and close device according to claim 13, wherein the rail member is made by extrusion molding.

17. An automatic open and close device according to claim 13, wherein a controller that controls the linear motor is contained within the movable element.

18. An automatic open and close device according to claim 1, wherein the stator is covered by a case that is made of aluminum.

* * * * *